United States Patent [19]

Fujita et al.

[11] Patent Number: 4,987,889

[45] Date of Patent: Jan. 29, 1991

[54] METHOD FOR CONTROLLING FUEL AT AN ACCELERATION TIME OF AN ELECTRONICALLY-CONTROLLED FUEL ENGINE

[75] Inventors: Hirokatsu Fujita, Kyoto; Kimito Kashiwabara, Kameoka; Yoshiaki Kanno, Hiemji, all of Japan

[73] Assignees: Mitsubishi Jidosha Kogyo Kabushiki, Tokyo; Mitsubishi Denki Kabushiki Kaisha, Tokyo, both of Japan

[21] Appl. No.: 468,629

[22] Filed: Jan. 23, 1990

[51] Int. Cl.[5] ..... F02M 51/00

[52] U.S. Cl. ..... 123/492

[58] Field of Search ..... 123/492, 493

[56] References Cited

U.S. PATENT DOCUMENTS

| | | | |
|---|---|---|---|
| 4,490,792 | 12/1984 | Deutsch et al. | 123/492 |
| 4,573,443 | 3/1986 | Watanabe et al. | 123/492 |
| 4,685,436 | 8/1987 | Oba | 123/492 |
| 4,725,954 | 2/1988 | Takao et al. | 123/492 |
| 4,753,210 | 6/1988 | Fujimoto et al. | 123/492 |
| 4,889,100 | 12/1989 | Nakaniwa et al. | 123/492 |
| 4,897,791 | 1/1990 | Sekozawa et al. | 123/492 |

FOREIGN PATENT DOCUMENTS

| | | | |
|---|---|---|---|
| 0046343 | 3/1984 | Japan | 123/492 |
| 5968531 | 4/1984 | Japan . | |
| 0090729 | 5/1984 | Japan | 123/492 |
| 0093935 | 5/1984 | Japan | 123/492 |
| 0096446 | 6/1984 | Japan | 123/492 |
| 60-201406 | 10/1985 | Japan . | |
| 62-157257 | 7/1987 | Japan . | |
| 63-65149 | 3/1988 | Japan . | |

*Primary Examiner*—Tony M. Argenbright
*Assistant Examiner*—Robert E. Mates
*Attorney, Agent, or Firm*—Hedman, Gibson, Costigan & Hoare

[57] ABSTRACT

In a fuel supply control method including determining a cylinder at a suction stroke in a multiple cylinder internal combustion engine at each generation of a first predetermined crank angle position signal and injecting/supplying into a cylinder at a suction stroke a first amount at fuel which is computed by a first technique based on a sucked amount of air, A, and number of engine rotations, N, representing an engine load, a method comprises determining a cylinder at a suction stroke for asynchronous injection at each generation of a second crank angle position signal which is nearer to a top dead center of each cylinder than the first predetermined crank angle position signal; detecting a throttle valve opening for each predetermined time Ts and computing a throttle value opening variation $\Delta\Theta$; and injecting/supplying, upon determining the variation $\Delta\Theta$ as being greater than a predetermined value, a second amount of fuel corresponding to the variation $\Delta\Theta$ into the cylinder which has been determined by the second crank angle position signal as being at the suction stroke and into a cylinder at a corresponding exhaust stroke. By so doing, there is an increased chance of being able to correct an incremental fuel which is asynchronously injected into a cylinder at the suction stroke and cylinder at the exhaust stroke, thus ensuring an enhanced response of the vehicle to an engine output at a time of acceleration.

4 Claims, 4 Drawing Sheets

3/4

METHOD FOR CONTROLLING FUEL AT AN ACCELERATION TIME OF AN ELECTRONICALLY-CONTROLLED FUEL ENGINE

Technical Field

The present invention relates to a method for controlling fuel at an acceleration time of an electronically-controlled fuel engine.

Prior Art

A fuel supply method is widely known which, upon each generation of a detection signal corresponding to a predetermined crank angle position of each cylinder on a multiple cylinder type internal combustion engine with an electromagnetic fuel injection valve provided immediately upstream of the respective suction valve of the cylinder, computes an amount of fuel on the basis of a parameter value and numbers of engine rotations representing an engine load, such as an amount of air supplied and pressure in the suction tube, and injects/supplies a computed amount of fuel into the corresponding cylinder. In such a fuel supply control method, the timing at which fuel is injected/supplied into the respective cylinder is started at a time considerably earlier than the start of a suction stroke, for example, at an 75° CA preceding a top dead center at the suction stroke, so as to suppress an amount of uncombusted hydrocarbon exhausted at a time of low-speed operation. If, for example, the engine is placed at an idle state at the time of injecting fuel and, thereafter, the engine is run at a rapid acceleration with a throttle valve fully opened before the suction stroke is started, air at the full-opened throttle time is supplied into a corresponding cylinder, while, on the other hand, fuel supplied is restricted to a level necessary to an idle operation, thus leading to a fuel shortage state. From this viewpoint it is desirable that the fuel injection timing be started during the suction stroke or at a time as near as possible to the suction stroke.

Since the number of rotations of the engine necessary to evaluate an amount of fuel is detected by measuring the period of time over which a signal corresponding to, for example, the aforementioned predetermined crank angle position is detected, so that a delay is involved upon the detection of the number of rotations of the engine. Detecting the parameter value representing the engine load, such as an amount of air flowing across an air flow sensor of Karman vortex type, requires at least that period of time corresponding to that at which the aforementioned crank angle position signal is generated. If, in order to eliminate an error of measurement resulting from the pulsation of suction air, a sequential average of values of measurement at the time of generating a signal corresponding to the respective crank angle position is used as an air flow amount detection value, then it is not possible to detect a momentary amount of air flowed. If the engine is rapidly accelerated with the throttle valve fully opened during a suction stroke in the case where a value of a flowed amount of air detected by the air flow sensor of Karman vortex type is to be used for the calculation of the fuel amount, only an amount of fuel required at an idle state of the engine is supplied into the corresponding cylinder at the suction stroke due to a delay of detection against the amount of air sucked. It has not been possible to, in the case where the engine is rapidly accelerated with the throttle valve in the fully opened state during the suction stroke, inject a requisite added amount of fuel into the corresponding cylinder at the suction stroke against an increase in the sucked amount of air resulting from the full opening of the throttle valve, so long as the aforementioned Karman vortex type air flow sensor is used which involves a delay upon the detection of an amount of air sucked.

In order to ensure the requisite amount of fuel at the time of acceleration, a controller for the engine as shown in FIG. 3 detects a variation Δ Ⓗ in the opening of the throttle valve at each sampling time Ts of for example, 10 ms which is not synchronized with the number of rotations of the engine; when the variation Δ Ⓗ in the opening of the throttle valve is greater than a predetermined value, takes it as the driver's trying to accelerate the vehicle; and allows the added amount of fuel which corresponds to the variation Δ H in the opening of the throttle valve to be synchronously injected into the cylinder at the suction stroke and cylinder at the exhaust stroke in synchronism with the sampling time Ts which is not synchronous with the rotation of the engine. That is, the controller determines whether or not the asynchronous injection should be effected for each sampling time Ts and, if yes, allows the asynchronous injection to be performed on the cylinder which has been determined as being at the suction stroke at an angle which is 75° before top dead center (hereinafter referred to as BTDC 75°) and on the cylinder at the exhaust stroke at that time.

Now assume, for example, a 4-cylinder MPI (multipoint injection) engine in which fuel injection and ignition are carried out in an order of #1 cylinder, #3 cylinder, #4 cylinder and #2 cylinder. In the engine, a crank angle sensor delivers not only a crank angle signal (hereinafter referred to a CA signal) which rises at BTDC 75° and falls at BTDC 5°, but also a TDC signal when a specified cylinder (for example, #4 cylinder) comes to the top dead center at the suction stroke for the determination of the cylinder. That is, it is possible to determine to which cylinder a BTDC 75° signal corresponds by counting the rise of the BTDC signal from the aforementioned TDC signal. By so doing, it is possible to determine a cylinder, for example, a cylinder at the suction stroke, at each 180° CA at which the BTDC 75° signal rises. That is, that cylinder which has been determined as being at the suction stroke upon a rise of the BTDC 75° signal is determined to be still at that suction stroke until the next BTDC 75° signal rises after the 180° CA.

The determination of the aforementioned cylinder and the time period over which a suction valve of the so determined cylinder at the suction stroke is actually opened will be explained below with reference to FIG. 4. The determination of the aforementioned cylinders is updated for every 180° CA at each BTDC 75° of a cylinder sequence of #1→#3→#4→#2. For example, the process of obtaining a BTDC 75° signal of the #2 cylinder from that of the #4 cylinder will be explained below by way of example. In the aforementioned process, the period of time, A, from a time t1 at which the BTDC 75° signal for the #4 cylinder is obtained to a time t2 at which the BTDC 75° signal for the #2 cylinder is obtained is so determined that the #4 cylinder is at the suction stroke. Here, the suction valve of the #4 cylinder is actually opened over a period of time, B, from BTDC 20° for the #4 cylinder to an angle which is 50° after top dead center (hereinafter referred to as ATDC 50°) for the #2 cylinder. Thus the determination of whether or not the asynchronous injection should be performed, as set forth above, is made for each sampling time Ts. If the asynchronous injection is so determined as to be performed until at the angle BTDC 75° of the #2 cylinder (#4 ATDC 105°), then it can be done on the #4 cylinder at the suction stroke and on the #2 cylinder at the exhaust stroke.

Here, with the engine in the idle state (for example, 700 rpm), the crank shaft is rotated through an angle of about 40° CA during the sampling time of 10 ms. If, when the #4 cylinder, for example, is at the suction stroke, the engine is accelerated with the throttle valve fully opened at a timing preceding the angle ATDC 65° of the #4 cylinder, that is, an angle which is 40° CA behind the ATDC 105° of the #4 cylinder at which the determination is terminated that the #4 cylinder is at the suction stroke, for example, at the timing preceding an angle which is 40° CA ahead of the top dead center of the #4 cylinder - #4 ATDC 40° -, then a time period of over 10 ms is left from the #4 ATDC 40° to #4 ATDC 105° (#2 BTDC 75°) at which the next determination is made for the corresponding cylinder. For this reason, the determination whether a variation Δ Ⓗ in the opening of the throttle valve for 10 ms is greater than a predetermined value is made before the #4 ATDC 105°. If the aforementioned variation Δ Ⓗ in the opening of the throttle valve is determined as being greater than the predetermined value, asynchronous injections S4*a* and S2*a* are effected for the #4 cylinder which is determined at that time as being at the suction stroke and for the #2 cylinder at the exhaust stroke. For this reason, a proper amount of fuel is supplied against an amount of air, A1, sucked at the #4 cylinder.

However, if the throttle valve is fully opened at the timing following the #4 ATDC 65°, for example, the #4 ATDC 85° as shown in FIG. 3, the period of time from the #4 ATDC 85° to the #4 ATDC 105° at which the determination of the cylinder is made will be below 10 ms. For this reason, the determination whether or not the variation Δ Ⓗ in the opening of the throttle valve for 10 ms is greater than the predetermined value is made at a timing following the #4 ATDC 105°. Even if the variation Δ H in the opening of the throttle valve is detected as being greater than the predetermined value, asynchronous injection is not performed for the #4 cylinder since, at a timing following the #4 ATDC 105°, a switching from the #4 cylinder to the #2 cylinder is effected for asynchronous injection. That is, asynchronous injection is performed for the #2 and #1 cylinders which are subsequently entered into the suction and exhaust strokes, respectively.

In the case where, at the timing preceding the ATDC 65° of the #4 cylinder, the throttle valve is fully opened from the idle state of the engine, asynchronous injection can be effected for the #4 cylinder at the suction stroke and the #2 cylinder at the exhaust stroke. In the case where, at the timing following the ATDC 65° of the #4 cylinder, the throttle valve is fully opened from the idle state of the engine, however, it is not possible to perform asynchronous injection for the #4 cylinder at the suction stroke and #2 cylinder at the exhaust stroke. That is, upon the full opening o the throttle from the idle state of the engine at the timing following the ATDC 65° of the #4 cylinder, fuel is supplied by a normal injection S4 into the #4 cylinder. Since, therefore, proper fuel correction is not performed against an increase A2 in the amount of air for the #4 cylinder, an air/fuel ratio A/F becomes an extremely lean level. As a result, a lean spike is produced, generating a "torque down" state as indicated by T2 in FIG. 3.

Disclosure of the Invention

It is accordingly an object of the present invention to provide a method for controlling fuel at a time of accelerating an electronically controlled fuel injection engine, which, upon each arrival of a cylinder at a suction stroke at a position near a top dead center, switchingly determines that cylinder to be subjected to asynchronous injection; and, upon determining a throttle valve opening variation $\Delta\theta$ at each sampling time Ts as being greater than a predetermined value, asynchronously injects fuel into the cylinder which has been determined as being a suction stroke at the position near the top dead center and into a cylinder at a corresponding exhaust stroke, whereby there is enhanced chance of being able to asynchronously inject fuel into the cylinder at that suction stroke and cylinder at that exhaust stroke to obtain an enhanced response of a vehicle to an engine output at a time of acceleration.

According to the present invention, a fuel supply control method for determining a cylinder at a suction stroke at each generation of a first signal corresponding to a predetermined crank angle position of each cylinder in a multiple cylinder internal combustion engine and injecting/supplying into that cylinder at that suction stroke a first amount of fuel which is computed by a first technique based on a parameter value and number of engine rotations representing an engine load is characterized by a method for controlling fuel at a time of accelerating an electronically controlled fuel injection engine which determines a given cylinder at a suction stroke for asynchronous injection, for each second crank angle position signal corresponding to a position nearer to the top dead center than the first predetermined crank angle position signal, detects a throttle valve opening for every predetermined time and computes a throttle valve opening variation, and, upon determining the aforementioned variation as being greater than a predetermined value, injects/supplies a second amount of fuel corresponding to that variation into the cylinder which has been determined by the second crank angle position signal as being at the suction stroke and into a cylinder at a corresponding exhaust stroke.

According to the present method for controlling fuel at a time of accelerating an electronically controlled fuel injection engine, it is possible to provide an increased chance for asynchronously injecting fuel into a cylinder at a suction stroke and cylinder at an exhaust stroke, an aspect which is a fuel correction at an initial phase of acceleration on an MPI (multi-point injection) engine, and to perform a proper fuel correction against a temporary variation of air.

BEST MODE FOR CARRYING OUT THE INVENTION

The embodiment of the present invention will be explained below with reference to the accompanying drawings.

Figure 2:
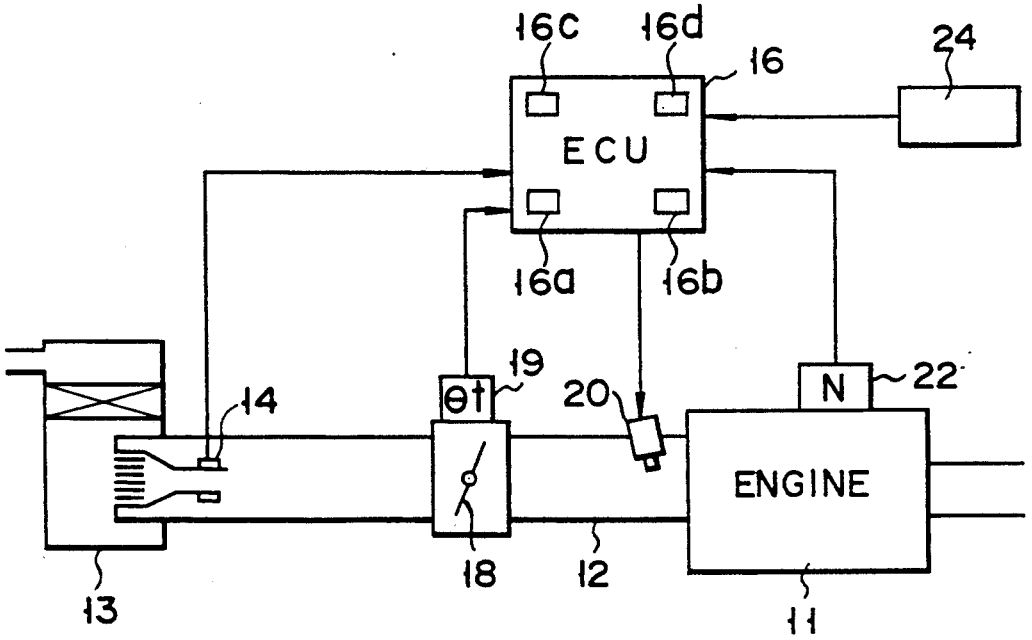
FIG. 2 is a diagrammatic view showing a fuel supply controller for carrying out the method of the present invention.
Figure 3:
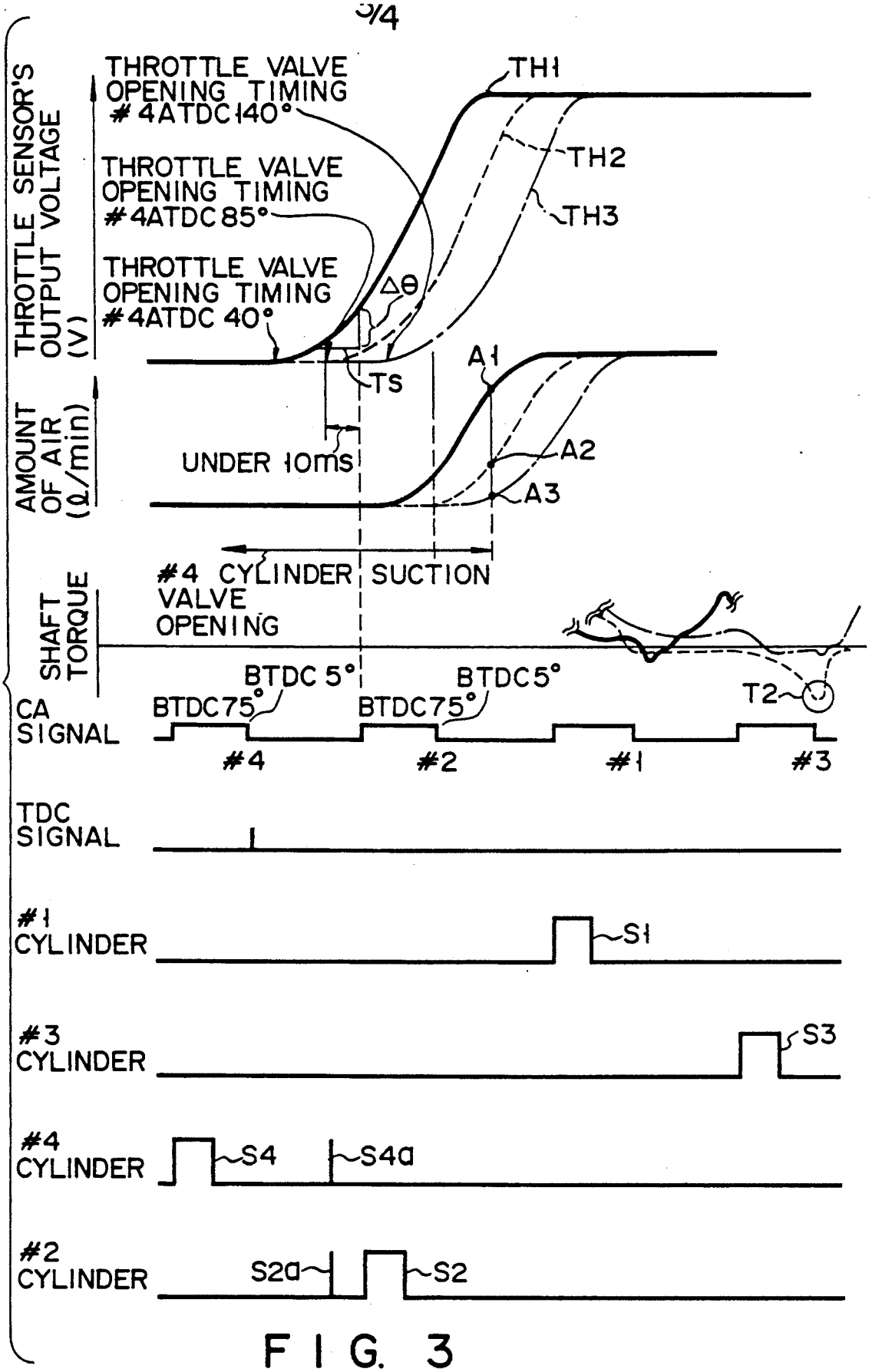
FIG. 3 is a timing chart showing a relation among a crank angle signal, amount of air, throttle sensor's output voltage, normal injection, asynchronous injection, etc. associated with a method for controlling fuel at a time of accelerating a conventional, electronically controlled fuel injection engine.

FIG. 2 shows a diagrammatic view showing a fuel supply controller for carrying out the method of the present invention. In FIG. 2, reference numeral 11 shows a multiple cylinder internal combustion engine, such as a 4-cylinder engine, and 12 shows a suction tube which is connected to a suction port of each cylinder. An air cleaner 13 is mounted on the "outer air" side of the suction tube 12 with a Karman vortex air flow sensor 13 mounted there. The air flow sensor 14 is electrically connected to an input side of an electronic control unit (ECU) 16 to supply a Karman vortex generation cycle signal to the electronic control unit 16. A throttle valve 18 is arranged partway of the suction pipe 12. Between the throttle valve 18 and a suction valve, not shown, of the respective cylinder is provided an injection valve 20 which is located immediately upstream of the respective suction valve. The respective injection valve 20 is connected to the electronic control unit 16 and driven by a drive signal from the electronic control unit 16.

Figure 1:
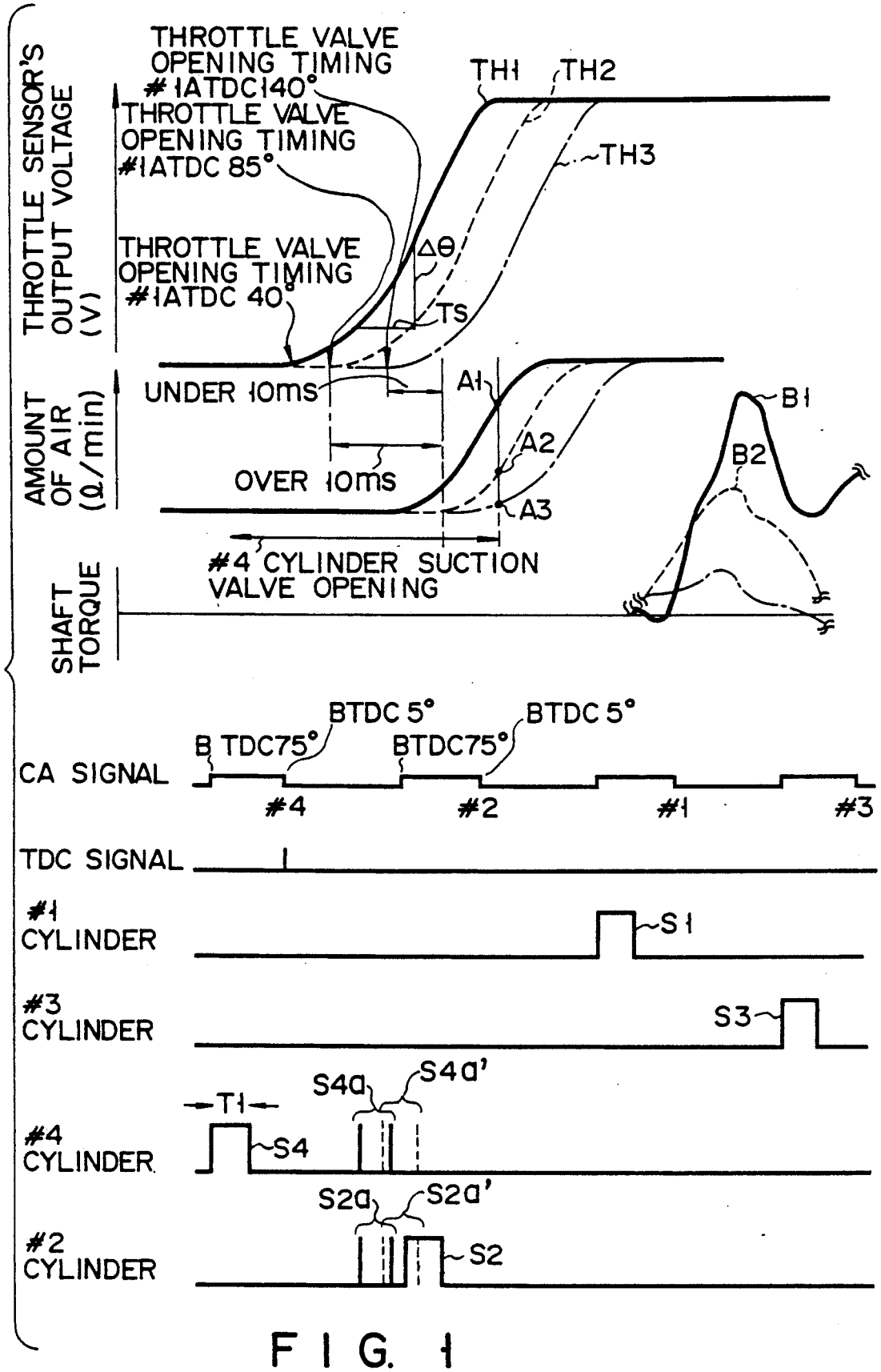
FIG. 1 is a timing chart showing a relation among a crank signal, amount of air, throttle sensor's output voltage, normal injection, asynchronous injection, etc. associated with a present method for controlling fuel at a time of accelerating an electronically controlled fuel injection engine.
Figure 4:
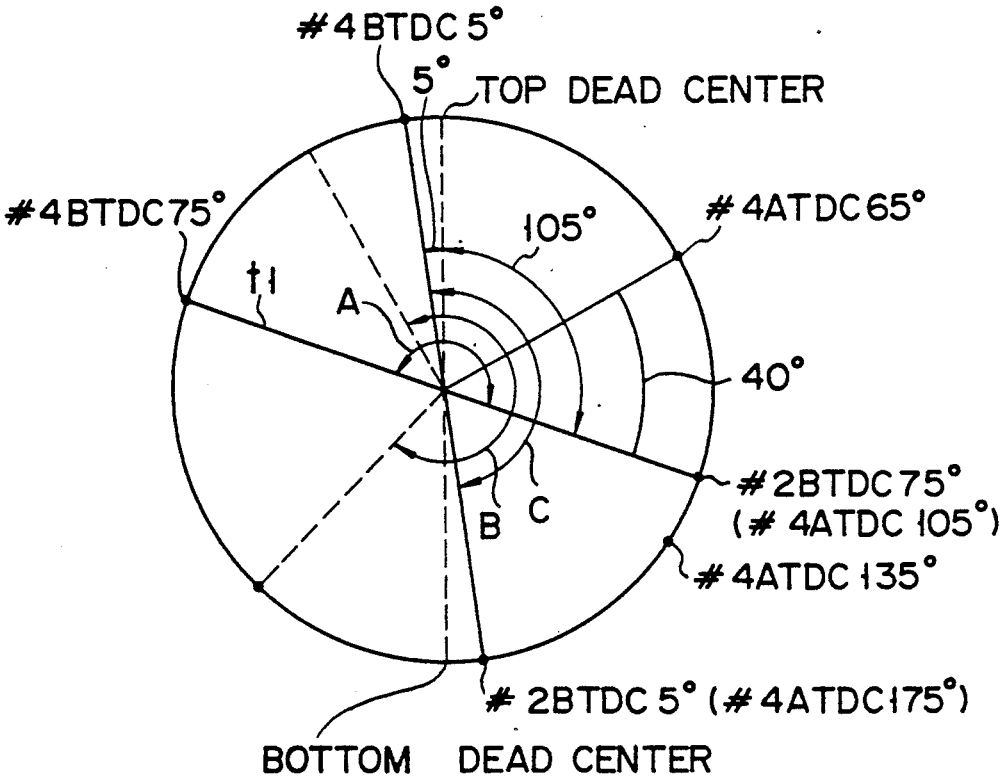
FIG. 4 is a view showing a cylinder determination time period and time period at which a suction valve of an associated cylinder is opened.

A throttle sensor Ht 19 for detecting the opening of the throttle valve 18, crank angle position sensor (N) 22 for detecting a predetermined crank angle position (for example, a top dead center position of the suction stroke) of the respective cylinder, and sensor 24 for detecting engine operation parameter values, such as the engine water temperature and atmospheric pressure, are electrically connected to the input side of the electronic control unit 16. The crank angle position sensor 22 delivers, as outputs, a crank angle (CA) signal which rises at a timing of BTDC 75° of each cylinder and falls at a timing of BTDC 5° as shown in FIG. 1 and a TDC signal for cylinder determination, that is, a TDC signal when a top dead center at a specific cylinder such as the #4 cylinder is reached. That is, the electronic control unit 16 sequentially updates, upon each detection of a BTDC 75° signal cylinder data for normal injection, which is stored in memory **16*a*, with the aforementioned TDC signal as a reference and, upon each detection of a BTDC 5° signal, cylinder data for asynchronous injection which is stored in memory 16*b*. In this way, the electronic control unit 16 determines a cylinder at a suction stroke for normal injection, upon receipt of the BTDC 75° signal for each 180° CA, and a cylinder at a suction stroke for asynchronous injection, upon receipt of the BTDC 5° signal for each 180° CA. Thus, a cylinder upon being determined by the BTDC 75° signal as being at the suction stroke for normal injection is held as cylinder data in memory 16*a* until the next BTDC 75° signal is obtained at a timing following the 180° CA. A cylinder upon being determined by the BTDC 5° signal as being at the suction stroke for asynchronous injection is held as cylinder data in memory 16*b* until the next BTDC 5° signal is obtained at a timing following the 180° CA. In the determination of a cylinder for normal injection in FIG. 4**, for example, the #4 cylinder upon being determined as being at the suction stroke at a timing of BTDC 75° is determined as being at the suction stroke over a period of time, A, from the BTDC 75° to the next BTDC 75°. In the determination of a cylinder for asynchronous injection, the #4 cylinder upon being determined as being at the suction stroke at a timing of BTDC 5° is determined as being at the suction stroke over a period of time, C, from BTDC 5° to the next BTDC 5° C.

A method for controlling fuel at an acceleration time on the aforementioned fuel supply controller will be explained below. The electronic control unit 16 performs a cylinder determination upon each receipt of a BTDC 75° signal to update the cylinder data in memory **16*a*. By so doing, the injection valve 20 of the corresponding cylinder is opened, starting fuel injection and, at the same time, allowing the fuel time count operation of a count timer 16*c*. The electronic control unit 16 computes, upon each receipt of the BTDC 75° signal, the number of engine rotations, N, based on a cycle from the receipt of a previous BTDC 75° signal to that of the present BTDC 75° signal. The electronic control unit 16 also computes an amount of air, A, based on a Karman vortex generation cycle signal coming from the air flow sensor 14. Thus the electronic control unit 16 computes, based on the number of engine rotations, N, and amount of air, A, an A/N value corresponding to an amount of air which is sucked by one suction stroke of the cylinder on the engine—a first procedure. The electronic control unit 16 determines a fuel injection time T1 of the injection valve 20 by multiplying the A/N value by a predetermined coefficient and performing a multiplication/addition operation of various correction factors, such as the temperature of the engine. The electronic control unit 16 computes, based on the fuel injection time T1, a time at which the injection valve 20 is closed and then set a timer 16*d*. When the count value of the timer 16*c* coincides with that of the timer 16*d*, the injection valve 20** is closed, completing a fuel injection, that is a so-called normal injection, which is synchronized with the BTDC 75° signal.

If, in the determination of a cylinder at a timing the BTDC 75°, the #4 cylinder, for example, is determined as being at a suction stroke, a drive signal as shown in FIG. 1 is supplied to the injection valve 20 of the #4 cylinder, performing a normal injection S4. During the normal run of the engine, normal injection is done to that cylinder which has been determined as being at the suction stroke. In this way, normal injections S2, S1 and S3 are performed on the #2, #1 and #3 cylinders, respectively, as in the case of the #4 cylinder.

The electronic control unit 16 reads the throttle valve opening out of the throttle sensor 19 for each sampling time Ts such as 10 ms and determines whether or not a difference (throttle valve opening variation) between a previously detected throttle valve opening and a presently detected throttle valve opening is greater than the predetermined value. If yes, the electronic control unit 16 takes it as the driver's trying to accelerate the vehicle, computes an accelerated increment of fuel corresponding to the aforementioned variation $\Delta$ H and asynchronously injects fuel into a cylinder corresponding to the cylinder data in the memory **16*b*** and a cylinder at the corresponding exhaust stroke in synchronization with the aforementioned determination, not in synchronization with the normal injections S1 to S4 which are made in synchronization with the aforementioned BTDC 75°. With the engine in an idle state (700 rpm), the crank shaft is rotated through an angle of about 40° CA for a time Ts.

Now let it be assumed that, with the #4 cylinder at the suction stroke as shown in FIG. 1, the throttle valve is fully opened from the idle state of the engine at a timing corresponding to an angle which is 40° ahead of the top dead center of the #4 cylinder (hereinafter referred to the #4 ATDC 40°). Since, in this case, it takes over 10 ms to reach the BTDC 5° of the #2 cylinder (#4 ATDC 175°), if the variation Δ Ⓗ is determined as being greater than the predetermined value, the fuel is asynchronously injected into the #4 cylinder at the suction stroke at a timing of this determination and, at the same time, into the #2 cylinder at the exhaust stroke.

Since it takes over 10 ms to reach the ATDC 175° of the #4 cylinder in the case where the throttle valve is fully opened from the idle state of the engine at a timing corresponding to an angle which is 85° after top dead center of the #4 cylinder (hereinafter referred to the #4 ATDC 85°), if the variation Δ Ⓗ is determined as being greater than the predetermined value for every sampling time Ts, asynchronous injection S4*a*′ is performed on the #4 cylinder at the suction stroke, and asynchronous injection S2*a*′ on the #2 cylinder at the exhaust stroke, in synchronism with this determination.

Let it be assumed that the throttle valve is fully opened at a timing of #4 ATDC 40° or #4 ATDC 85°. Since, in this case, an injected amount of fuel corresponding to the asynchronous injections S4*a*, S2*a*, S4*a*′, S2*a*′ is incremented against the #4 cylinder at the suction stroke and #2 cylinder at the exhaust stroke, a proper fuel correction is made against sucked amounts of air, A1 and A2, of the #4 cylinder and hence a gain of a better transition torque can be obtained as indicated by B1 and B2 in FIG. 1.

If, on the other hand, the throttle valve is fully opened at a timing of #4 ATDC 140°, an asynchronous injection determination is not ended because under 10 ms is left from #4 ATDC 140° to #4 ATDC 175°. In this case, fuel cannot be asynchronously injected into the #4 cylinder at the suction stroke and #2 cylinder at the exhaust stroke. Even if the throttle valve is fully opened at a timing following the #4 ATDC 140° at which time a sucked amount of air at the #4 cylinder is slightly increased, it is not necessary to perform fuel correction. Thus no bad effect is exerted on an output torque even in the event of not asynchronously injecting fuel into the #4 cylinder at the suction stroke and #2 cylinder at the exhaust stroke.

In the case where the determination of a given cylinder at a suction stroke to allow it to be subjected to asynchronous injection is made for every BTDC 5° and the throttle valve opening variation Δ Ⓗ for a time 10ms is determined as being greater than the predetermined value, fuel is asynchronously injected into that cylinder which has been determined as being at the suction stroke at a timing of BTDC 5°. Thus, even in the event of fully opening the throttle valve at a timing of ATDC 135°, the determination of the asynchronous injection is ended in any range from ATDC 135° to BTDC 5° (ATDC 175°). As a result, there is an increased chance of fuel being able to be asynchronously injected into a cylinder at a suction stroke and cylinder at an exhaust stroke, hence ensuring an enhanced response of the vehicle to the output of the engine at a time of acceleration.

Although, in the aforementioned embodiment, the determination of the cylinder at the suction stroke for asynchronous injection has been explained as being made at a timing of an angle which is 5° behind the top dead center of that cylinder, it may be made at a timing near an angle preceding the top dead center or angle following the top dead center of that cylinder at that suction stroke.

Although, in the aforementioned embodiment, fuel has been explained as being asynchronously injected into the cylinder at the suction stroke and cylinder at the exhaust stroke, it may be asynchronously injected into a cylinder at a suction stroke alone.

We claim:

1. A method of controlling the supply of fuel at a time of accelerating an electronically controlled fuel injection multiple cylinder engine comprising:

(a) determining the arrival of a cylinder at a suction stroke at each generation of a signal corresponding to a first predetermined crank angle position of each cylinder and injecting, into that cylinder at the suction stroke, a first amount of fuel which is computed by a first technique based on a parameter value and a number of engine rotations representing an engine load (b) determining the arrival of a cylinder at a suction stroke for asynchronous injection, at each generation of a second crank angle position signal which is nearer to a top dead center than the first predetermined crank angle position signal;

(c) detecting a throttle valve opening for each predetermined time and computing a throttle valve opening variation; and (d) upon determining the variation as being greater than a predetermined value, injecting a second amount of fuel corresponding to that variation into the cylinder which has been determined by the second crank angle position signal as being at a suction stroke.

2. A method of controlling the supply of fuel at a time of accelerating an electronically controlled fuel injection multiple cylinder engine comprising:

(a) determining the arrival of a cylinder at a suction stroke at each generation of a signal corresponding to a first predetermined crank angle position of each cylinder and injecting into that cylinder at the suction stroke a first amount of fuel which is computed by a first procedure based on a parameter value and a number of engine rotations representing an engine load (b) determining the arrival of a cylinder at a suction stroke for asynchronous injection, at each generation of a second crank angle position signal which is nearer to a top dead center than the first predetermined crank angle position signal;

(c) detecting a throttle valve opening for each predetermined time and computing a throttle valve opening variation; and (d) upon determining the variation as being greater than a predetermined value, injecting a second amount of fuel corresponding to the variation into that cylinder which has been determined by the second crank angle position signal as being at a suction stroke and into a cylinder at a corresponding exhaust stroke.

3. The method according to claim 1, wherein said second crank angle position signal is generated at a timing of an angle which is 5° before top dead center of each cylinder.

4. The method according to claim 2, wherein said second crank angle position signal is generated at a timing of an angle which is 5° before top dead center of each cylinder.

* * * * *